United States Patent [19]

Cohen

[11] 4,095,811

[45] Jun. 20, 1978

[54] CHUCK JAW OPERATING AND CLOSING DEVICE

[76] Inventor: Max Cohen, 272 Gilsum St., Keene, N.H. 03431

[21] Appl. No.: 749,605

[22] Filed: Dec. 13, 1976

[51] Int. Cl.[2] ..... B25B 13/44; B25G 1/02

[52] U.S. Cl. ..... 279/1 K; 81/3.4

[58] Field of Search ..... 279/1 K, 1 Q, 62; 81/177 L, 177 F, 121 R, 3.4

[56] References Cited

U.S. PATENT DOCUMENTS

| | | | |
|---|---|---|---|
| 2,189,068 | 2/1940 | Hubbell | 279/62 |
| 2,458,626 | 1/1949 | Noripe | 279/62 |
| 2,631,482 | 3/1953 | Rinehart | 81/3.4 |
| 2,823,133 | 3/1958 | Silverman | 279/1 K |

*Primary Examiner*—Othell M. Simpson
*Assistant Examiner*—Z. R. Bilinsky
*Attorney, Agent, or Firm*—Leonard S. Michelman; Abraham B. Feinstein

[57] ABSTRACT

This invention is concerned with drills that are driven by electrical motors upon which there is movable chuck jaws for changing the size of the drill bit. The invention comprises of two parts, a drive sleeve, and a studded anchor ring. By means of the studded anchor ring, the operator is able to hold the spindle of the drill motionless so that it will not rotate, while by means of the drive sleeve, the outer cylinder of the chuck can be turned, thus locking or unlocking the jaws of the chuck to remove or insert the desired drill bit. The drive sleeve consists of a medium hard resilient type member, preferably made of rubber in the shape of a cylinder. The anchor ring cmprises a material also of a medium hard rubber or the like with three studs molded at intervals of 120 degrees apart on the inner surface. The studs engage the pivot hole in the spindle and prevent it from turning while the drive sleeve operates the opening and closing of the jaws of the chuck.

2 Claims, 28 Drawing Figures

CHUCK JAW OPERATING AND CLOSING DEVICE

This invention is concerned with means for changing drill bits used with an electrical driven motor drill which has a chuck and wherein the drill bits or cutting tools are secured within the jaws of the chuck.

It is the object of the within invention to provide new and novel means for replacing the use of the key for interchanging drill bits in an electrical drill having chuck jaws that open and close.

It is an additional object of the within invention to provide a means that makes it easier to change drill bits within the jaws of a drill chuck without the use of a key.

It is yet an additional object of the within invention to provide two component parts: a drill sleeve, and a studded anchor ring, whereby the operator of a drill may interchange the drill bits by placing the studded anchor ring around the surface of the chuck so as to hold the spindle of the drill still, while rotating the drive sleeve of the outer cylinder which opens and closes the jaws of the chuck.

It is a further object of the within invention to provide a simple arrangement of parts that can replace the use of a chuck key to replace drill bits, said parts being inexpensive to manufacture and simple in construction.

These and many other objects are obtained by the use of the within invention, reference being made to the following detailed description in which.

DESCRIPTION OF COMPONENTS PARTS

Figure 4:
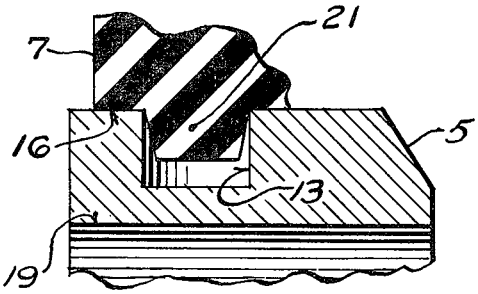
FIG. 4 is a schematic view of the studded anchor ring in position in the pivot hole of the chuck inner cylinder.

The electric drill 1 has a conventional chuck 2 with chuck jaws 3. There is a drill bit 22 within the jaws 3. Circumscribing the splined teeth 12 is the outer cylinder 4. The chuck outer cylinder 4 has an outer surface 17. The chuck inner cylinder 5 can been seen in the views of FIGS. 4 and 6. The drive sleeve 6 for the chuck assembly is located between the electric drill (motor area) 1 and the chuck 2. The drive sleeve 6 is shaped like a washer and has an inner surface 15. The splined teeth 12 of the chuck assembly are located between the chuck outer cylinder 4 and the chuck 2.

Figure 8:
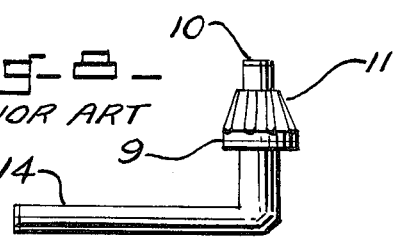
Fig-8- PRIOR ART
FIG. 8 is a front elevational view of a typical key that is used generally with a chuck assembly to open or close the jaws of the chuck.

The conventional key 9 is shown in FIG. 8 and has a key pivot 10 with the bevel gear 11 and the handle 14.

Figure 1:
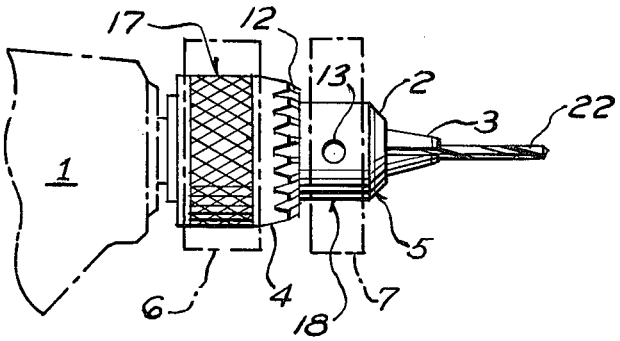
FIG. 1 is a side elevational view of that portion of a drill showing a chuck assembly with the two members of this invention in position thereon.
Figure 2:
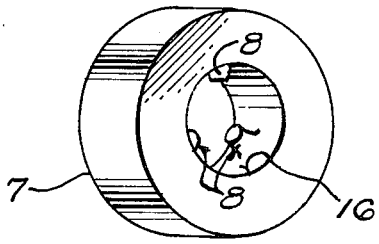
FIG. 2 is a perspective view of a studded anchor ring.
Figure 3:
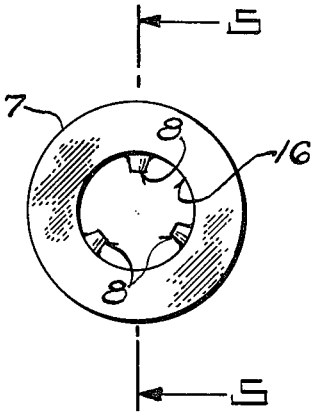
FIG. 3 is a front elevational view of the studded anchor ring.

The studded anchor ring is shown in a perspective view in FIG. 2, as can be seen, it is shaped somewhat like a lifesaver having flat surfaces at each end with a cylindrical flat surface between said end flat surfaces and an inner flat surface 16 parallel to the outer flat surface. There are molded metal or rubber studs 8 on the inner surface 16. They are located 120° apart since the inner surface 16 is that of a circle. The studs can also be seen in the view of FIG. 3.

Figure 6:
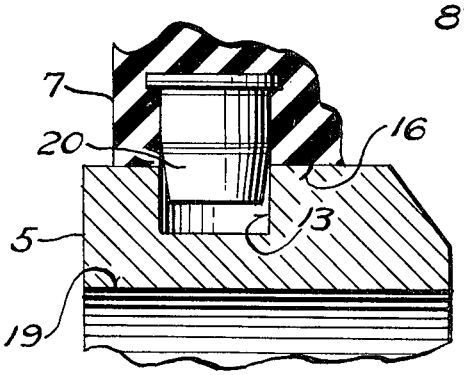
FIG. 6 is also an exploded and schematic view showing the steel stud of the studded anchor ring in position in the pivot of the chuck inner cylinder.
Figure 7:
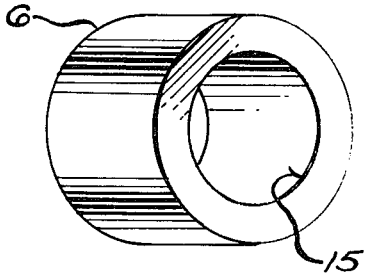
FIG. 7 is a perspective view of the drive sleeve.

There is in the conventional inner diameter 19 of the chuck inner cylinder 5, a pivot hole 13. The inner surface 16 of the studded anchor ring 7 is placed into contact with the outer surface of the chuck outer cylinder 5. The stud 8 may be made of a hard rubber material 21. These details of construction can be seen clearly in the views of FIGS. 4 and 6. A stud 8 made of steel is shown in the view of FIG. 6. It is designated by the numeral 20. It is contemplated that whether a steel stud 20 be used or a hard rubber stud 21 be used, the spirit and scope of the invention will be accomplished.

The chuck inner cylinder 4 has an outer periphery 18.

THE PROCEDURE TO CHANGE THE DRILL BIT

In order to change the drill bit, it is necessary that the teeth or jaws 3 of the chuck 2 be opened and then closed. In order to open the jaws 3, previously the key 9 shown in FIG. 8 was used. The key pivot 10 was placed inside the pivot hole 12 and the teeth of the bevel gear 11, as the handle 14 is turned, engage the teeth referred to as the splined teeth 12, on the surface of the outer chuck cylinder 4. This causes the spindle of the drill 1 to remain stationary, because the key pivot 10 locks same into position and it also permits the outer periphery 4 of the chuck outer cylinder to be rotated so that the chuck jaws 3 will open, releasing the grip and permitting the removing and the replacing of the drill bit 22. The handle 14, of course, would then be rotated in the opposite direction to tighten the chuck jaws 3 about the bit 22.

Figure 5:
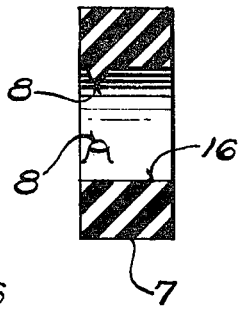
FIG. 5 is a cross-section view taken along line 5—5 of FIG. 3.

With the components of this invention in lieu of the key, the operator takes the studded anchor ring 7 and places same over the surface of the chuck 2. It is simple to do. Since the chuck 2 has a beveled area at 5 and since the composition of the material of the studded anchor ring 7 is resilient, a slight forcing action by the operator places the studded anchor ring 7 and the rubber stud 20 or the steel stud 21 then engage the three openings 13 in the surface of the chuck inner cylinder 5. See FIG. 5. Before this happens, of course, it is necessary to place the drive sleeve 6 in position. The operator has to slide it over not only the chuck inner cylinder 5, but also over the splined teeth 12, and the inner diameter 15 of the drive sleeve 6. Because the dimensions, as previously stated, are crucial, there is a friction fit developed between the surfaces 15 of the inner diameter of the drive sleeve 15, and the outer surface 17 of the chuck outer cylinder 4.

Once the drive sleeve 6 and the studded anchor ring 7 are in position, the operator holds one hand on the studded anchor ring 7 and with the other hand twists the drive ring 6 clockwise or counterclockwise depending upon whether or not he wants the chuck jaws to open or close. This prevents the drill spindle from rotating. The drill bit 22 is either inserted or removed when the chuck jaws 3 have been opened, and the bit 22 is locked into position when it is closed.

Only one embodiment of this invention has been shown. The two species of the studs 8, either steel 20 or rubber 21, are mounted on the inner surface of the studded anchor ring 7. It is contemplated that the arrangement of the studded anchor ring 7 with the friction fitting drive sleeve 6 are adaptable to various types of drills depending upon the sizes. A dimension that is sufficiently critical so that the drive sleeve 6 will always have a friction fit with that surface of the chuck assembly is a prerequisite.

It is also contemplated that pins may be used instead of the studs 8 as long as they are sufficiently strong and resilient to engage the pivot holes 13 located in the surface 18 of the chuck inner cylinder.

In consideration of the foregoing, I claim:

1. A means for opening and closing the chuck jaws of a chuck assembly to insert or replace drill bits in power drills, said chuck assembly having a chuck, said chuck having an outer periphery, pivot holes in the other periphery of the chuck, a chuck outer cylinder, said chuck outer cylinder having an outer periphery, comprising, an anchor ring, said anchor ring having a flat inner surface, studs extending inwardly from said flat inner surface of said anchor ring, whereby when said anchor ring is placed over the outer periphery of said chuck, the studs engage the pivot hole in the chuck periphery; an annular drive sleeve made of a material that is resilient, said drive sleeve having a flat inner surface of a size to contact securely the periphery of the chuck outer cylinder, when said annular drive sleeve is placed over the said periphery of said chuck outer cylinder, whereby when the anchor ring is rotated and the drive sleeve is held in a fixed position, the chuck outer cylinder will remain in a fixed position and the chuck jaws will open or close in accordance with the direction of the rotation of the anchor ring.

2. A means for opening and closing the chuck jaws as described in claim 1 wherein the studded anchor ring is made of a resilient material and the studs are molded and locked therein, said studded anchor ring being in the shape of a truncated cylinder.

* * * * *